US006064801A

United States Patent [19]

Stokes et al.

[11] Patent Number: 6,064,801

[45] Date of Patent: May 16, 2000

[54] HEATING ELEMENT ASSEMBLY FOR WATER HEATER WITH IC CONTROLLER AND TEMPERATURE SENSOR MOUNTED IN THERMAL RELATION

[75] Inventors: Paul W Stokes, Burwood; Philip T Hancock, Plympton; Kevin A Altschwager, Hope Valley, all of Australia

[73] Assignee: Stokes (Australasia) Limited, Ringwood, Australia

[21] Appl. No.: 09/043,714

[22] PCT Filed: Sep. 25, 1996

[86] PCT No.: PCT/AU96/00605

§ 371 Date: Jun. 4, 1998

§ 102(e) Date: Jun. 4, 1998

[87] PCT Pub. No.: WO97/12182

PCT Pub. Date: Apr. 3, 1997

[30] Foreign Application Priority Data

Sep. 25, 1995 [AU] Australia ..... PN 5607

[51] Int. Cl.[7] ..... F24H 9/20; H05B 1/02

[52] U.S. Cl. ..... 392/501

[58] Field of Search ..... 219/441, 523, 219/530, 540; 392/441, 498, 447, 311, 501; 126/501

[56] References Cited

U.S. PATENT DOCUMENTS

| | | | |
|---|---|---|---|
| 3,725,643 | 4/1973 | Clausse | 219/441 |
| 4,730,099 | 3/1988 | Bleckman | 219/338 |
| 4,978,833 | 12/1990 | Knepler . | |
| 5,278,941 | 1/1994 | Ward . | |
| 5,442,157 | 8/1995 | Jackson | 219/492 |
| 5,635,092 | 6/1997 | O'Neil | 219/441 |

FOREIGN PATENT DOCUMENTS

| | | | |
|---|---|---|---|
| 0 233 136 | 8/1987 | European Pat. Off. . | |
| 2228634 | 8/1990 | United Kingdom . | |
| 2 262 594 | 6/1993 | United Kingdom . | |
| 2265070 | 9/1993 | United Kingdom | 392/497 |
| 2 272 139 | 5/1994 | United Kingdom . | |

*Primary Examiner*—John A. Jeffery
*Attorney, Agent, or Firm*—Foley & Lardner

[57] ABSTRACT

An integral water heating assembly is mounted to the tank wall or bottom of a water heater. The integral water heating assembly in accordance with the invention is able to detect conditions such as overheating of the heating element or boil dry conditions and accordingly switch off power to the heating element. This sensing and switching of the electrical power to the water heating element is accomplished without any sensing element external to the water heating assembly housing. The water heating assembly includes a sheathed heating element having ends which pass through apertures in the housing. The heating element preferably has a number of U-shaped bends and an intermediate section which contacts the housing at a point. The electrodes of the heating element are connected to a source of electrical energy through a control unit. The control unit includes a switching element for turning the power on and off, the switching element being controlled by a silicon chip. The contact between the heating element and the housing is towards the top of the housing. A temperature input to the controller is provided by a temperature sensing element which is mounted between the control unit and the point of contact between the heating element and the housing. The switching element is preferably a triac which is in thermal contact with the internal surface of the housing.

23 Claims, 4 Drawing Sheets

HEATING ELEMENT ASSEMBLY FOR WATER HEATER WITH IC CONTROLLER AND TEMPERATURE SENSOR MOUNTED IN THERMAL RELATION

TECHNICAL FIELD

This invention relates to a heating element assembly for a water heater and in particular to a self regulating heating element assembly.

BACKGROUND OF THE INVENTION

In the general construction of a water heater, a heating element is provided to heat the water within the water heater vessel and a separate thermostatically controlled device is provided to maintain the water at a predetermined temperature. In such devices, it is also necessary to ensure that the level of water in the vessel is covering the heating element whenever the element is heating. If water is not covering the element, failure of the element eventually occurs. Thermostatic control devices are generally not able to safeguard against element failure in these "boil dry" situations and a separate override facility is required to turn off the heating element.

In addition, it is desirable to control the operation of a water heater using an integrated circuit controller which operates the heating element through a triac. However solid state devices generally fail at temperatures approaching 120° C. leaving little margin between the operating temperature of water heaters, when operating near the boiling point of water and the failure temperature of these devices.

When designing a water heater to operate at a temperature near the boiling point of water, there are a number of possible conditions each having associated problems which must be overcome for the water heater to operate effectively and reliably.

During the heating of the water, while the vessel is full, the electrical power is provided to the heating element continuously. Electronic switching devices such as a triac which switch the power to the element, generate heat at a rate in proportion to the current flowing in the element. When the operating temperature is near the boiling point of water, this heat needs to be dissipated efficiently to ensure the device does not over heat.

Commonly used triacs control the flow of current with an integrated controller which are a few millimeters square and about 0.5 mm thick. The maximum temperature this controller can tolerate is 120° C. If the integrated controller overheats, the triac loses its ability to control the flow of current and remains in the "on" position permanently. When the triac is in a latched "on" position, the water in the water heater boils away causing a separate over temperature protection device to fuse, permanently opening the circuit. When the water is almost at say 95° C., the element is still on full heating duty cycle and thus has the maximum current flowing through the element. Hence the heat produced by the triac must be dissipated to the water to prevent the triac reaching its maximum permitted temperature.

Another condition of water heater operation which must be controlled is when an operator switches on the power to the heating element when the heating element is not covered with water. With no water, the element quickly heats up to red heat and will self-destruct if no protective action is taken to prevent this. An extremely hot element is also dangerous if accidentally touched and if in contact with flammable material causes a fire hazard.

SUMMARY OF THE INVENTION

It is an object of the present invention to provide an integral heating element assembly for a water heater which overcomes the above perceived problems of water heater operation and control.

Accordingly the invention provides a water heating assembly for a water heater including:

a housing for mounting to said water heater, a sheathed heating element secured to said housing, and a control unit mounted within said housing for controlling the supply of electrical energy to the heating element from a source of electrical energy. The control unit includes a switching means and a temperature sensing means adapted to detect the temperature of a region of the housing in proximity to the temperature sensing means, an intermediate section of the heating element thermally contacting the housing at a point such that the temperature sensing means is between the point of contact of said heating element with the housing and the switching means.

In a preferred form of the invention the temperature sensing means is positioned sufficiently close to the point of contact of the heating element with the housing to sense an increase in temperature of the element. In one embodiment of the invention, the temperature sensing means is positioned adjacent but not in direct contact with the point of contact between the housing and the heating element. The positioning of the temperature sensing means may be such that the temperature of the heating element is measured when the temperature sensing region of the housing is not covered with water.

When the water heater is full, the water acts as a large thermal mass holding the temperature of any metal surfaces contacted by the water at approximately the same temperature as the water.

A planar heat conductive element may be positioned between the temperature sensing means and the housing. The heat conductive element may be made of copper or aluminium and may extend to a point within the interior of the housing adjacent to the point of contact of the heating element with the exterior of the housing. When the temperature sensing region of the housing is covered by water, heat from the heating element is dissipated to the water and also transferred to the housing through the point of contact with the housing. However, before the transferred heat is able to affect the temperature sensing means, the heat is spread laterally through the heat conductive element and transferred to the housing in the vicinity of the point of contact with the heat conductive element and the water contacting the enlarged area of the housing.

Once the temperature sensing region of the housing is not covered by water, the heat from the heating element cannot be quickly spread laterally by the heat conductive element and dissipated or dispersed to the water contacting the housing in proximity to the point of contact with the heat conductive element. Since the heat conductive element has a higher co-efficient of thermal conductivity than the housing, heat is transferred through the heat conductive element faster and more directly than through the housing. This heat transferred through the heat conductive element is registered by the temperature sensing means as a rise in temperature triggering the switching means.

Preferably the switching means may include a triac for controlling the flow of electrical energy to the heating element. The operation of the triac may be controlled by an integrated circuit controller which receives a signal from the temperature sensing means. The switching means is preferably mounted in thermal contact with the housing so that heat can be conducted through the housing to the water.

The rate at which heat is dissipated from the triac is dependent on the area of metal in close contact with the water which is at a temperature approximating that of the triac, the thermal resistance of material between the triac and the water, and the ability of that material to laterally conduct heat, thereby increasing the effective area of material in contact with and conducting heat to the water.

In a preferred form of the invention, a high thermally conductive plate is provided between the switching means and the housing to conduct and spread the heat from the switching means to an area of the housing. The conductive material preferably has a high lateral thermal conductivity increasing the effective area of housing for transferring heat to the water and may be made of copper or aluminium. Preferably the plate is adhered to the interior of the housing and the switching means is mounted on the plate.

DESCRIPTION OF THE PREFERRED EMBODIMENT

Figure 1:
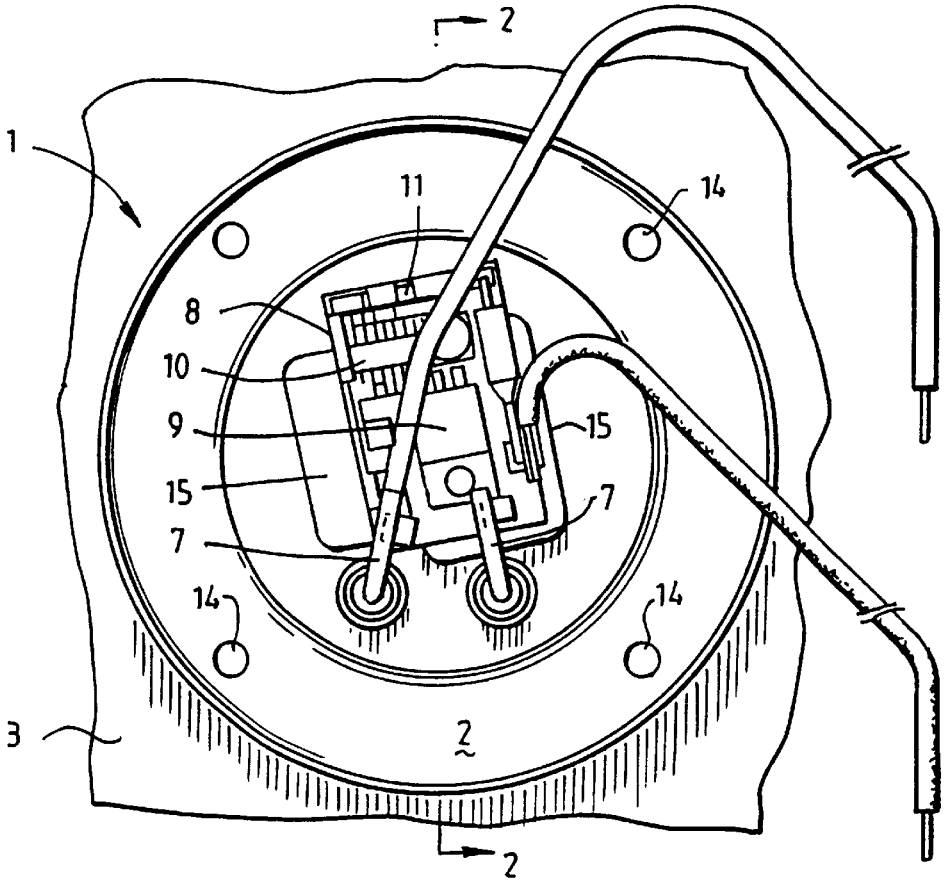
FIG. 1 is an elevational view of an embodiment of the invention.
Figure 2:
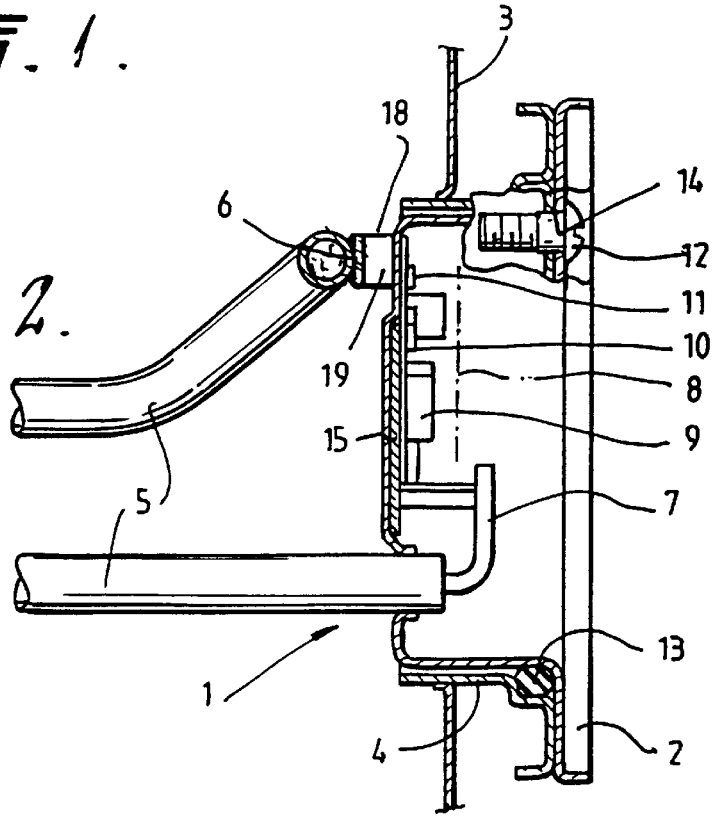
FIG. 2 is a sectional view through line 2—2 of the embodiment shown in FIG. 1.
Figure 3:
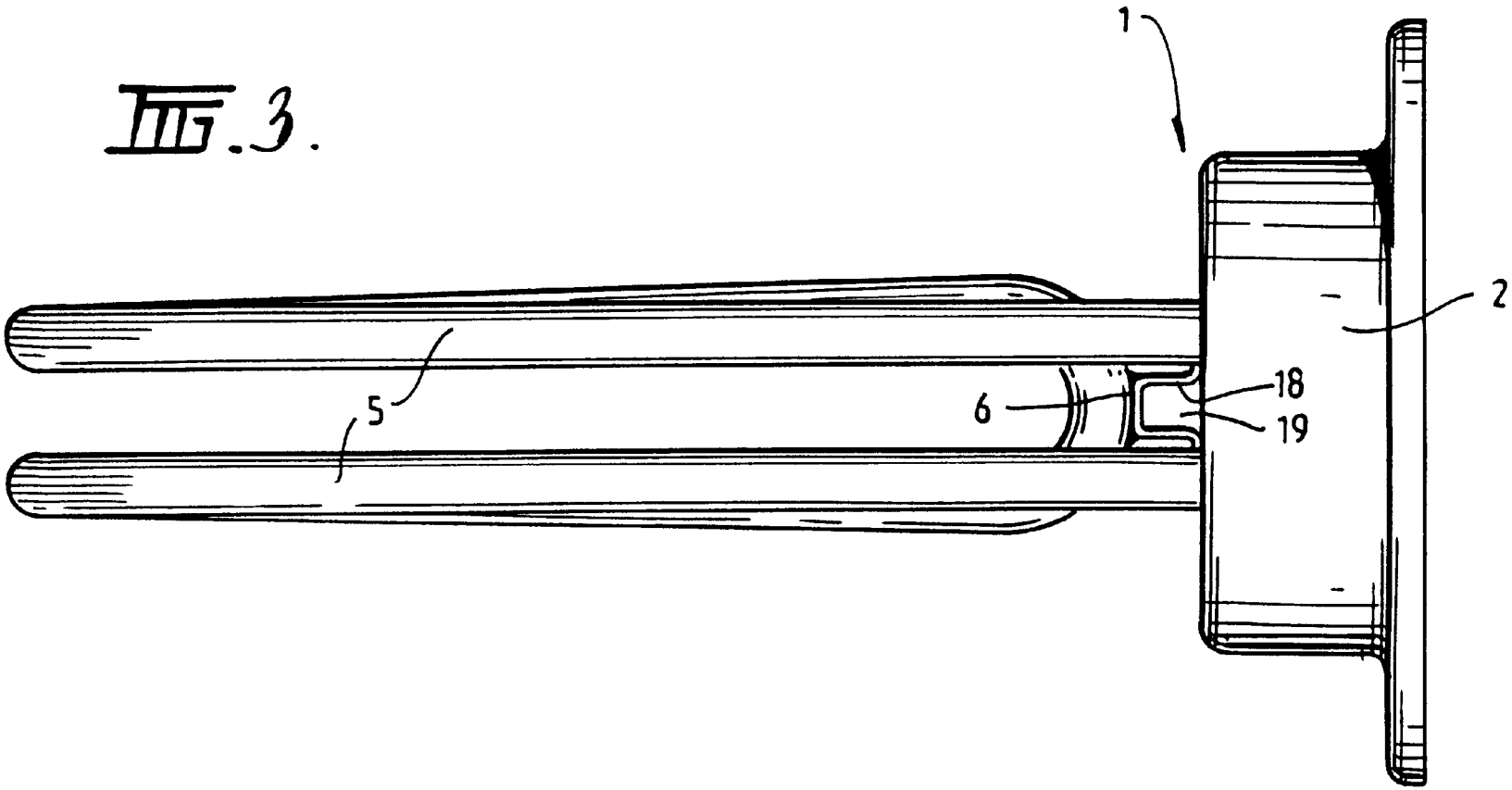
FIG. 3 is an end elevational view of the embodiment of the invention shown in FIG. 1.

Referring to FIG. 1 and FIG. 2, a heating element assembly 1 is shown including a housing 2 for mounting on a water heater. The tank wall 3 of the water heater has an opening preferably in the bottom of the side wall into which a mounting 4 is secured. A sheathed heating element 5 is provided, the ends of which preferably passes through apertures in the housing 2 and are secured to the housing by braising, welding, soldering or the like bonding process. The heating element 5 preferably has a number of U-shaped bends and extends substantially perpendicularly and an intermediate section which thermally contacts the housing at a point 6. The point of contact 6 is preferably above the ends of the heating element. The heating element 5 is preferably bonded to a heat transfer spacer attached to or formed in the housing at this contact point by welding, soldering or the like bonding process.

The electrodes 7 of heating element 5 are connected to a source of electrical energy (not shown) through a control unit 8. The control unit 8 includes a switching means 9 for turning the power on and off, the switching means being controlled by a silicon chip 10. A temperature input to the silicon chip 10 is provided by a temperature sensing means 11 which is preferably a thermistor or other commonly used temperature sensing device.

The housing 2 is held against the mounting 4 by mounting bolts 12 passing through apertures 14 in the housing 2 with a gasket 13 positioned between the housing 2 and mounting 4 to provide a water tight seal.

The silicon chip controller 10 is only a few millimeters square and about 0.5 to 1 mm thick. The maximum temperature which can be tolerated by the chip is about 120° C. As discussed earlier, if the controller overheats, the switching means 9 which is preferably a triac, loses its ability to switch the flow of current and remains on all of the time.

The triac also generates heat at a rate proportional to the current flowing in the element. If the water heater is operating at near the boiling point of water, say 95° C., the heat generated by the triac must be dissipated to the water in contact with the housing to prevent heat building up and the controller reaching is maximum permitted temperature.

The rate at which heat is dissipated through the housing to the water is dependent upon the area of the housing which is at or about the temperature of the triac. While the area of the triac in contact with the housing may be sufficient to provide sufficient heat transfer through the housing to the water, the applicants have found that it is preferable to provide a high thermally conductive plate 15 between the triac and the housing 2. The conductive plate 15 has a high lateral thermal conductivity which quickly transfers heat laterally from the triac over the area of the conductive plate and then to the housing 2. Thus the effective available area of the housing for heat transfer to the water is substantially increased. Typical materials having a sufficiently high lateral thermal conductivity include copper and aluminium.

The temperature sensing means 11 is positioned on the control circuit board of the control unit 8 between the controller 10 on the point of contact of the heating element 5 with housing 2. The temperature sensing means 11 which may be a negative temperature coefficient (NTC) thermistor is in thermal contact with the housing.

When the water heater is full, the water acts as a large thermal mass holding the temperature of any metal surfaces contacting the water at approximately the same temperature as the water. The temperature sensing means 11 measures the temperature of the housing and hence the water in a region proximate the temperature sensing means.

As the level in the water heater decreases, the temperature sensing means will continue to detect the temperature of the water as long as the heating elements 5 are covered by water.

Once the level of water falls sufficiently to uncover part of the heating element, not all of the energy provided to the heating element is dissipated into the water. The temperature of the heating element increases and transfers heat to the housing through the point of contact 6.

The housing in the region of the point of contact 6 then heats up (since this section of housing is also uncovered) and the temperature rise is detected by the temperature sensing means 11 which causes the triac to switch off the power to the heating element 5. The temperature sensing means 11 is sufficiently close to the point of contact 6 between the heating element 5 and housing 2 to ensure that the rise in temperature is detected to enable the triac to be switched off.

Since the housing is generally made from a material such as stainless steel which does not have a particularly high lateral heat conductivity, a large amount of heat may be stored in the heating element and in the exposed housing before the temperature sensing means 11 detects the temperature rise and switches off the power to the heating element 5. This stored heat may eventually progress past the temperature sensing means after the power to the element 5 has been switched off increasing the temperature of the controller past its maximum temperature. Thus while the power has been switched off, the control unit may be damaged and unable to switch the triac on to supply power at a later time.

To increase the transfer of heat to the temperature sensing means so that the sensing means detects a rise in temperature of the heating element before too much thermal inertia can be built up, a planar heat conducting element (not shown) may be provided between the temperature sensing means 11 and the housing 2. The heat conducting element preferably is made of a material which has a high lateral thermal conductivity such as copper or aluminium and extends to the point of contact 6 of the heating element 5 with the housing 2.

When the heating element is covered with water, some heat may be transferred to the housing and if present, the heat conducting element. A heat transfer spacer preferably made of stainless steel, 18 may be formed in or attached to the housing 2 at the temperature sensing region of the housing. The heat transfer spacer 18 provides thermal contact between the intermediate section of the heating element 5 and the housing 2. The heat transfer spacer 18 has side walls and defines a gap 19 between the housing 2 and intermediate section of heating element 5. When the element is covered with water, some heat will be transferred to the housing 2 and through heating element 5. The gap 19 and reduced available cross-sectional area for conductive heat transfer through the walls ensures that sufficient heat can be dissipated through the heat transfer spacer 18 to the water and ensures that a significant amount of heat will not reach the temperature sensing means and be detected as an increase in water temperature until the water temperature in contact with the housing approaches the set point (usually 95°).

When the water level falls below the level of heat transfer spacer 18 the thermal contact between the heating element and the housing provided by the heat transfer spacer 18 ensures that enough heat is transferred from the heating element 5 through to housing 2 to trigger the temperature sensing means before too much thermal inertia can be built up in heating element and the housing.

The operation of the second embodiment is substantially the same as the first embodiment. Referring to the embodiment shown in FIGS. 4, 5 and 6, a bottom mounted heating element assembly 21 is shown including a housing 22 for mounting on a water heater. The tank wall of the water heater has an opening into which an apertured mounting plate 24 is secured. A sheathed element 25 is provided, the ends of which preferably pass through apertures (not shown) in the housing 22 and are secured to the housing by braising, welding, soldering or the like. The heating element 25 preferably has a section 26 intermediate the two ends of the heating element which thermally contacts the housing at a point 27 preferably through heat transfer spacer 36. Apart from the intermediate section of the heating element, the heating element is below the level of the top of the housing. Hence a substantial portion of the heating element may be below this level. The housing 22 is held against the mounting plate 24 by a number of mounting bolts 32 with a gasket 33 positioned between the housing 22 and tank wall to provide a watertight seal. The intermediate section 26 of the heating element 25 is preferably bonded to heat transfer spacer 36 formed in or attached to housing 22 or may be on the head of one of the mounting bolts 32.

The thermal connection to the top of the mounting bolt 32 through heat transfer spacer 36 ensures that when the heating element is covered, a sufficient amount of heat from the heating element 25 can be dissipated to the water thereby ensuring that a significant amount of heat will not be transferred to the housing. Hence the temperature sensing means does not detect an increase in water temperature and trigger switching means 29 until the water temperature around the heating assembly approaches the temperature set point.

The electrodes 38, 39 of the heating element are connected to the central unit 28 and the electrical energy to the electrodes is supplied by leads 40 from a source (not shown) and regulated by the control unit 28. The control unit 28 including the sensing means 31 the switching means 29 and silicon chip controller 30 is positioned on a ceramic circuit board 28*a* which preferably has a high thermal conductivity. The temperature sensing means 31 and switching means 29 preferably are in thermal contact with the housing for sensing the temperature of the water in contact with the housing and dissipating heat to the water respectively. As with the first embodiment, a heat conductive plate 35 preferably with a high lateral thermal conductivity may be provided between the switching means 28 and the housing 22 to increase the effective available area for heat transfer from the triac through the housing to the water.

The temperature sensing means 31 is positioned on the integrated circuit board of the control 28 between the controller 30 and the point of contact 26 between the heating element 25 and the housing 22. The temperature sensing means 31 measures the temperature of the housing 22 in a region proximate the temperature sensing means 31. Due to the relative thinness of the housing wall and the relatively high thermal conductivity of the stainless material used to construct the housing, the internal wall temperature of the housing will be substantially the same as the external wall temperature of the housing. Thus, the temperature being detected by the temperature sensing means on the internal side of the housing is substantially the same as the temperature of the adjacent external side of the housing and the water.

As long as the housing 22 is covered by water, the temperature sensing means 31 will continue to detect the temperature of the water. Once the level of water falls sufficiently to uncover the top surface 37 of the housing, the triac is no longer able to dissipate heat through the housing to the water and it is important that the temperature sensing means detects this condition as an increase in temperature and switches off the triac before reaching the maximum permitted temperature of the silicon controller 30. Consequently the temperature sensing means must be sufficiently close to the point of thermal contact 26 between the heating element 25 and the housing 22 to be able to register the net increase in the heat flowing from the heating element to the housing through the point of contact 27. This increase in heat flow results from the inability to dissipate heat through the heating element and heat transfer spacer to the water.

To further enhance the speed with which the temperature sensing means can detect a net increase in heat flowing to the housing, a planar heat conductive element (not shown) may be provided between the temperature sensing means 31 and the housing 22. The heat conductive element may be made of a material which has a high lateral thermal conductivity such as copper or aluminium and extends to the point of contact of the heating element with the housing 22 and may even contact the mounting bolt 32 in contact with the heating element.

While the element and housing are covered with water, the heat which is conducted from the heating element 25 to the housing will be further dissipated over the area of the heat conductive element through the housing to the water. Therefore the temperature sensing means will not be effected by the heating cycle of the heating element 25 while water covers the housing 22. Once the top of the housing is uncovered, the temperature sensing means is able to quickly detect the net increase in heat flowing to the housing. This may prevent the housing developing a thermal inertia which would heat the controller above its temperature tolerance even after the triac has switched off the power to the heating element.

Figure 4:
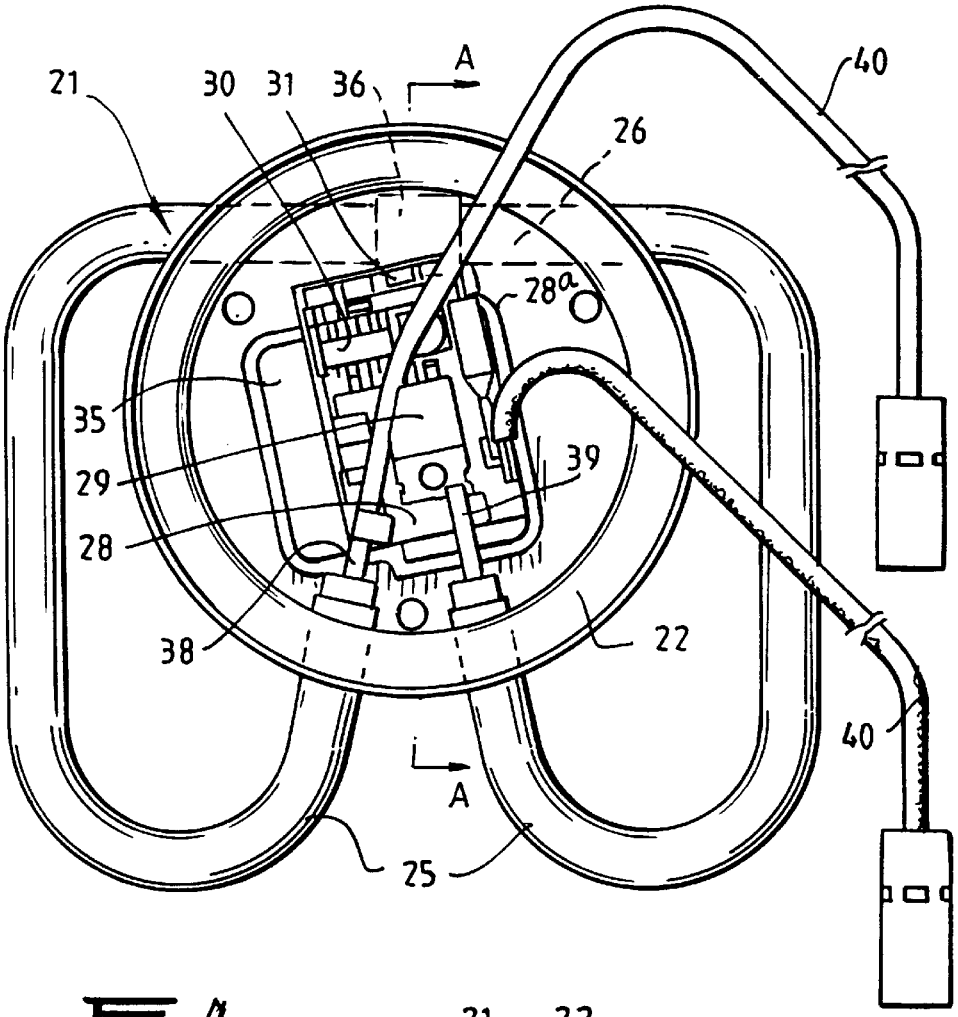
FIG. 4 is a bottom plan view of a second embodiment of the invention.
Figure 5:
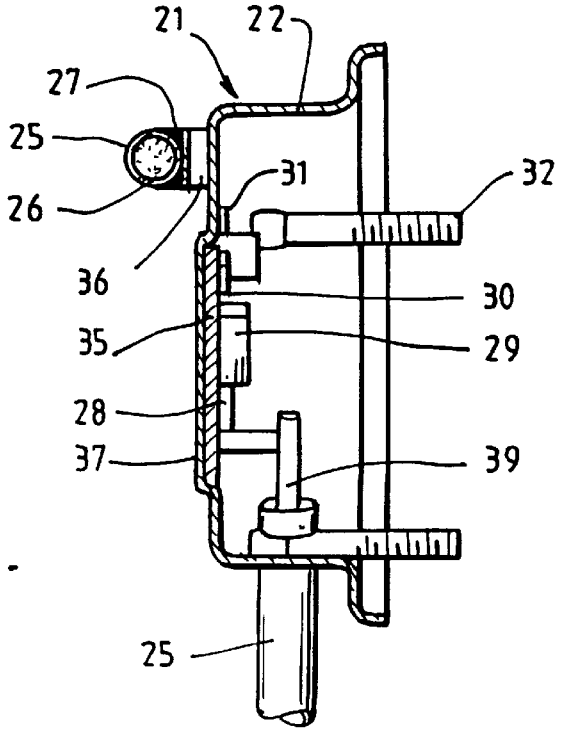
FIG. 5 is a sectional view through line A—A of FIG. 4.
Figure 6:
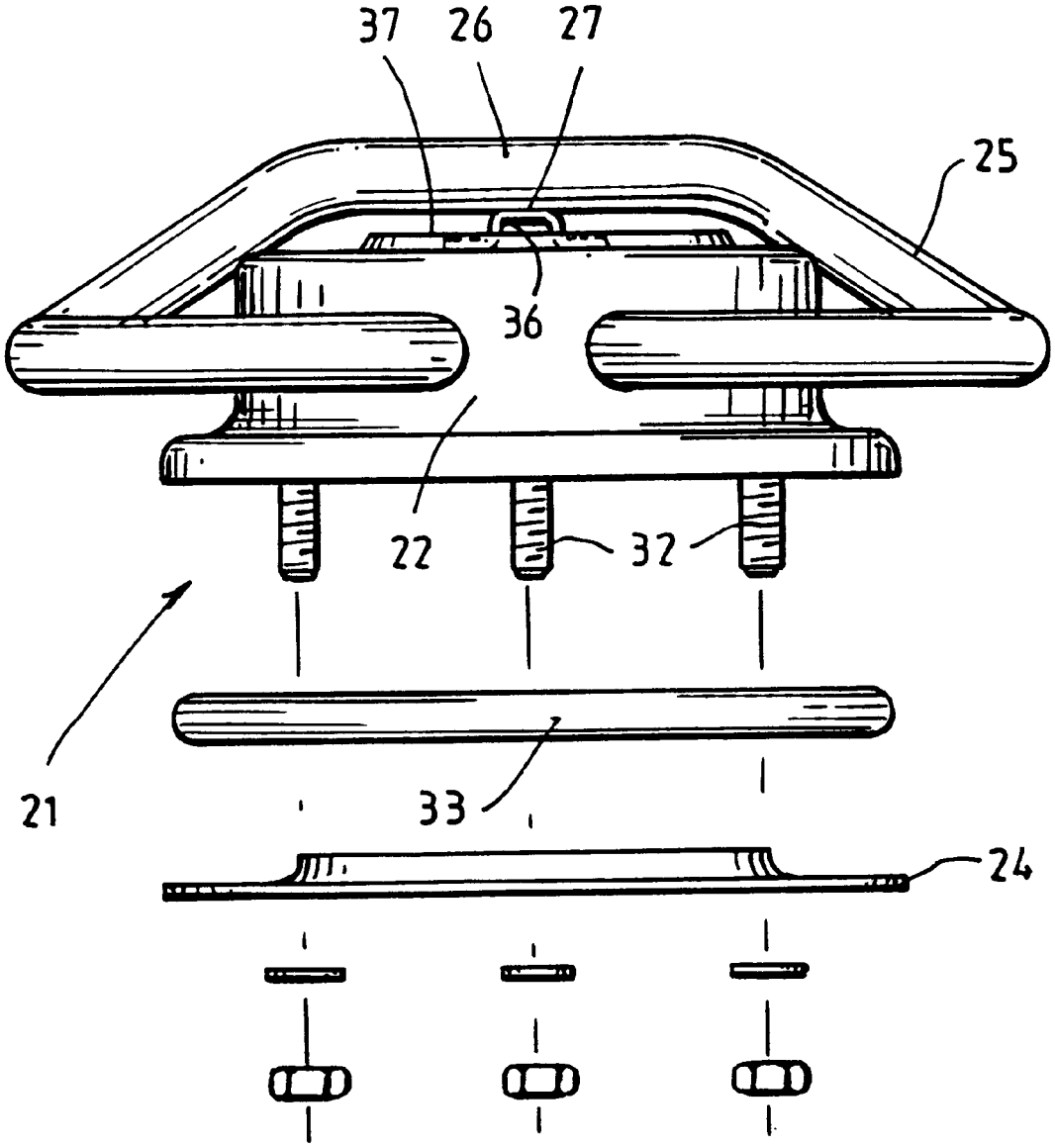
FIG. 6 is an end elevational view of the embodiment of FIG. 4

With a bottom mounted heating element such as shown in FIGS. 4, 5 and 6, the applicants have found that the water heater is preferably designed so that water which condenses on the lid of the water heater above the heating element does not drip on to the water heating assembly especially when the water heater is in a boil dry condition. Such a situation is likely to affect the temperature being sensed by the temperature sensing means and may result in the power to the electrodes being switched on for too long a period of time.

The heating cycle of the heating element assembly as the heating element is initially heating the water is typically . . . seconds on . . . seconds off. Once the water temperature has reached the set point temperature, the heating cycle will generally be 2 seconds on, 60 seconds off depending on the temperature sensed by the temperature sensing means 11.

The water heating assembly in accordance with the invention is able to be used in heating vessels such as urns or may also be used in water heating systems in which the water level is topped up whenever water is withdrawn from the heating vessel.

We claim:

1. A water heating assembly for a water heater including:

a housing for mounting to said water heater, a sheathed heating element having ends secured to said housing and an intermediate section between the ends of said heating element thermally contacting said housing at a point of contact, and a control unit mounted within said housing for controlling the supply of electrical energy to said heating element from a source of electrical energy, said control unit including a switching means having an integrated circuit controller mounted in thermal contact with said housing and a temperature sensing means positioned between said switching means and the point of thermal contact of said intermediate section of said heating element to said housing for detecting the temperature of a region of said housing in proximity to the temperature sensing means.

2. The water heating assembly of claim 1 wherein said temperature sensing means is positioned sufficiently close to the point of contact of said heating element with said housing to sense an increase in the temperature of said heating element.

3. The water heating assembly according to claim 2 wherein said temperature sensing means is positioned such that the temperature of the heating element is measured when the temperature sensing region of the housing is not covered with water.

4. The water heating assembly according to claim 1 wherein said temperature sensing means is positioned adjacent but not in direct contact with the point of contact between the housing and the heating element.

5. A water heating assembly according to claim 1 wherein a planar heat conductive element is positioned between said temperature sensing means and said housing, said planar heat conductive element being in thermal contact with said housing.

6. The water heating assembly according to claim 5 wherein said planar heat conductive element is able to conduct heat laterally at a faster rate than said housing.

7. The water heating assembly according to claim 6 wherein said planar heat conductive element is made from copper or aluminium.

8. The water heating assembly according to claim 6 wherein said planar heat conductive element extends at least from the temperature sensing means to a point within the interior of the housing adjacent to the point of contact of the heating element with the exterior of the housing.

9. The water heating assembly according to claim 1 wherein the switching means includes a triac for controlling the flow of electrical energy to the heating element, the operation of said triac being controlled by the integrated circuit controller which receives a signal from said temperature sensing means.

10. The water heating assembly according to claim 1 wherein a high thermally conductive plate is provided between the switching means and the housing to conduct and spread the heat from the switching means across said plate to the housing in contact with the high thermally conductive plate.

11. The water heating assembly according to claim 10 wherein the high thermally conductive plate has a high lateral thermal conductivity and thereby increases the effective area of the housing for transferring heat to the water from the switching means.

12. The water heating assembly according to claim 11 wherein the high thermally conductive plate is adhered to the interior of the housing and the switching means is mounted on the plate.

13. The water heating assembly according to claim 12 wherein the high thermally conductive plate is made from copper or aluminium.

14. The water heating assembly of claim 1 wherein the water heating assembly is mountable on a side wall of said water heater, said heating element having a plurality of U-shaped bends and extending substantially perpendicularly from said housing, the intermediate section of the heating element being above said ends of said heating element.

15. The water heating assembly of claim 14 wherein the intermediate section of the heating element is above a substantial portion of the heating element, said intermediate section of said heating element being attached to said housing by a heat transfer spacer.

16. The water heating assembly of claim 1 wherein the water heating assembly is mountable to the bottom of the water heater, a substantial portion of said heating element being below the uppermost surface of said housing, the intermediate point of contact of the heating element with said housing being on the uppermost surface of the housing.

17. An integral water heating assembly for a water heater including a housing for mounting to said water heater, a sheathed heating element having ends secured to said housing, an intermediate section of said heating element between said ends thermally contacting said housing at a point of contact, a control unit within said housing for controlling the supply of electrical energy to said heating element from a source of electrical energy including a switching means having an integrated circuit controller mounted in thermal contact with said housing and a temperature sensing means positioned between said switching means and the point of thermal contact of said intermediate section of said heating element to said housing for sensing the temperature of a region of said housing in proximity to the point of contact of said intermediate section of said heating element and said housing, and a heat conductive plate mounted within said housing to provide thermal contact between the switching means of said control unit and said housing.

18. The water heater assembly of claim 17 wherein the heat conductive plate is planar and secured to the interior of the housing, said switching means being mounted to the heat conductive plate.

19. The water heater assembly of claim 17 wherein the heat conductive plate has a higher lateral thermal conductivity than the housing and increases the effective area of the housing for transferring heat to the water from the switching means.

20. The water heating assembly of claim 19 wherein the planar heat conductive element is made from copper or aluminium.

21. The water heating assembly of claim 17 wherein the water heating assembly is mountable on a side wall of said water heater, said heating element having a plurality of U-shaped bends and extending substantially perpendicularly from said housing, the intermediate section of said heating element being above said ends of said heating element.

22. The water heating assembly of claim 21 wherein the intermediate point of contact of the heating element is above a substantial portion of the heating element, said intermediate section of said heating element contacting said housing through a heat transfer spacer.

23. The water heating assembly of claim 17 wherein the water heating assembly is mountable to the bottom of the water heater, a substantial portion of said heating element being below the uppermost surface of said housing, the point of contact of the intermediate section of said heating element with said housing being on the uppermost surface of the housing.

* * * * *